US010113262B2

(12) United States Patent
Wen

(10) Patent No.: US 10,113,262 B2
(45) Date of Patent: Oct. 30, 2018

(54) DRYER APPLIANCES AND METHODS FOR DIAGNOSING RESTRICTIONS IN DRYER APPLIANCES

(71) Applicant: General Electric Company, Schenectady, NY (US)

(72) Inventor: Yicheng Wen, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 947 days.

(21) Appl. No.: 14/452,609

(22) Filed: Aug. 6, 2014

(65) Prior Publication Data

US 2016/0040348 A1 Feb. 11, 2016

(51) Int. Cl.
*D06F 58/28* (2006.01)
*D06F 58/22* (2006.01)

(52) U.S. Cl.
CPC ..... *D06F 58/28* (2013.01); *D06F 58/22* (2013.01); *D06F 2058/289* (2013.01); *D06F 2058/2858* (2013.01); *D06F 2058/2864* (2013.01)

(58) Field of Classification Search
CPC .. D06F 58/28; D06F 58/22; D06F 2058/2858; D06F 2058/2864; D06F 2058/289; D06F 2058/287; D06F 2202/04; D06F 2204/04
See application file for complete search history.

(56) References Cited

U.S. PATENT DOCUMENTS

| | | | | |
|---|---|---|---|---|
| 6,792,694 | B2 * | 9/2004 | Lapierre | D06F 58/28 34/446 |
| 7,926,201 | B2 | 4/2011 | Kim et al. | |
| 8,387,272 | B2 * | 3/2013 | Kim | D06F 58/28 34/524 |
| 2006/0242858 | A1 * | 11/2006 | Beaulac | D06F 58/28 34/446 |
| 2008/0098615 | A1 * | 5/2008 | Kim | D06F 58/28 34/493 |
| 2008/0313921 | A1 * | 12/2008 | Oh | D06F 58/28 34/491 |
| 2013/0139402 | A1 * | 6/2013 | Hong | D06F 58/28 34/427 |
| 2013/0255101 | A1 * | 10/2013 | Lee | D06F 58/28 34/443 |

* cited by examiner

*Primary Examiner* — Jianying Atkinsson
*Assistant Examiner* — Tavia Sullens
(74) *Attorney, Agent, or Firm* — Dority & Manning, P.A.

(57) ABSTRACT

Dryer appliances and methods for diagnosing restrictions in dryer appliance are provided. A method includes obtaining a plurality of temperature readings during each operation of the dryer appliance by intermittently measuring a temperature of inlet air to the dryer appliance. The method further includes obtaining a heater status for a heater of the dryer assembly during each measurement of the temperature. The method further includes estimating an effective opening size in the dryer appliance during each operation of the dryer appliance based on the temperature and heater status for each of the plurality of temperature readings.

15 Claims, 4 Drawing Sheets

DRYER APPLIANCES AND METHODS FOR DIAGNOSING RESTRICTIONS IN DRYER APPLIANCES

FIELD OF THE INVENTION

The present subject matter relates generally to dryer appliances and associated methods, and more particularly to methods and apparatus for diagnosing restrictions in dryer appliances.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, a blower is utilized to flow the internal air from the vent duct to the exhaust duct. When operating the blower may pull air through itself from the vent duct, and this air may then flow from the blower to the exhaust conduit.

One issue that exists with dryer appliances is the possibility of restrictions in, for example, the vent duct or exhaust conduit. Restrictions decrease the effective operating size of the passages through which air flows during operation, and can be caused by, for example, lint build-up or other impediments lodged in such passages. Restrictions can prevent proper airflow, thereby reducing drying of articles in the dryer appliances. In some cases, restrictions can cause damage to dryer appliances, and can even result in fires. Accordingly, the ability to diagnose restrictions is of upmost importance.

Attempts have been made to diagnose restrictions in dryer appliances. However, typically known attempts generally require substantial additional hardware to be included in the dryer appliance, which can be costly. Further, many known attempts have proven to be ineffective or inaccurate. Still further, known attempts only provide an alert that a blockage exists when cleaning is required, and cannot provide any restriction trend tracking or time estimates before cleaning is required.

Accordingly, improved dryer appliances and methods for diagnosing restrictions in dryer appliances are desired. In particular, dryer appliances and methods that provide inexpensive and effective restriction monitoring, and that can provide restriction trend tracking and time estimates before cleaning is required, would be advantageous.

BRIEF DESCRIPTION OF THE INVENTION

In one embodiment, a method for diagnosing a restriction in a dryer appliance is provided. The method includes obtaining a plurality of temperature readings during each operation of the dryer appliance by intermittently measuring a temperature of inlet air to the dryer appliance. The method further includes obtaining a heater status for a heater of the dryer assembly during each measurement of the temperature. The method further includes estimating an effective opening size in the dryer appliance during each operation of the dryer appliance based on the temperature and heater status for each of the plurality of temperature readings.

In another embodiment, a dryer appliance is provided. The dryer appliance includes a cabinet defining an interior, a drum positioned within the interior, the drum defining a chamber for receipt of articles for drying, a heating assembly, and an inlet duct providing fluid communication between the drum and the heating assembly. The dryer appliance further includes an outlet assembly, the outlet assembly including a vent duct and an exhaust conduit. The dryer appliance further includes a temperature sensor and a controller, the controller in communication with the temperature sensor and the heating assembly. The controller is operable for obtaining a plurality of temperature readings during each operation of the dryer appliance by intermittently measuring a temperature of inlet air to the dryer appliance. The controller is further operable for obtaining a heater status for a heater of the dryer assembly during each measurement of the temperature. The controller is further operable for estimating an effective opening size during each operation of the dryer appliance based on the temperature and heater status for each of the plurality of temperature readings.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
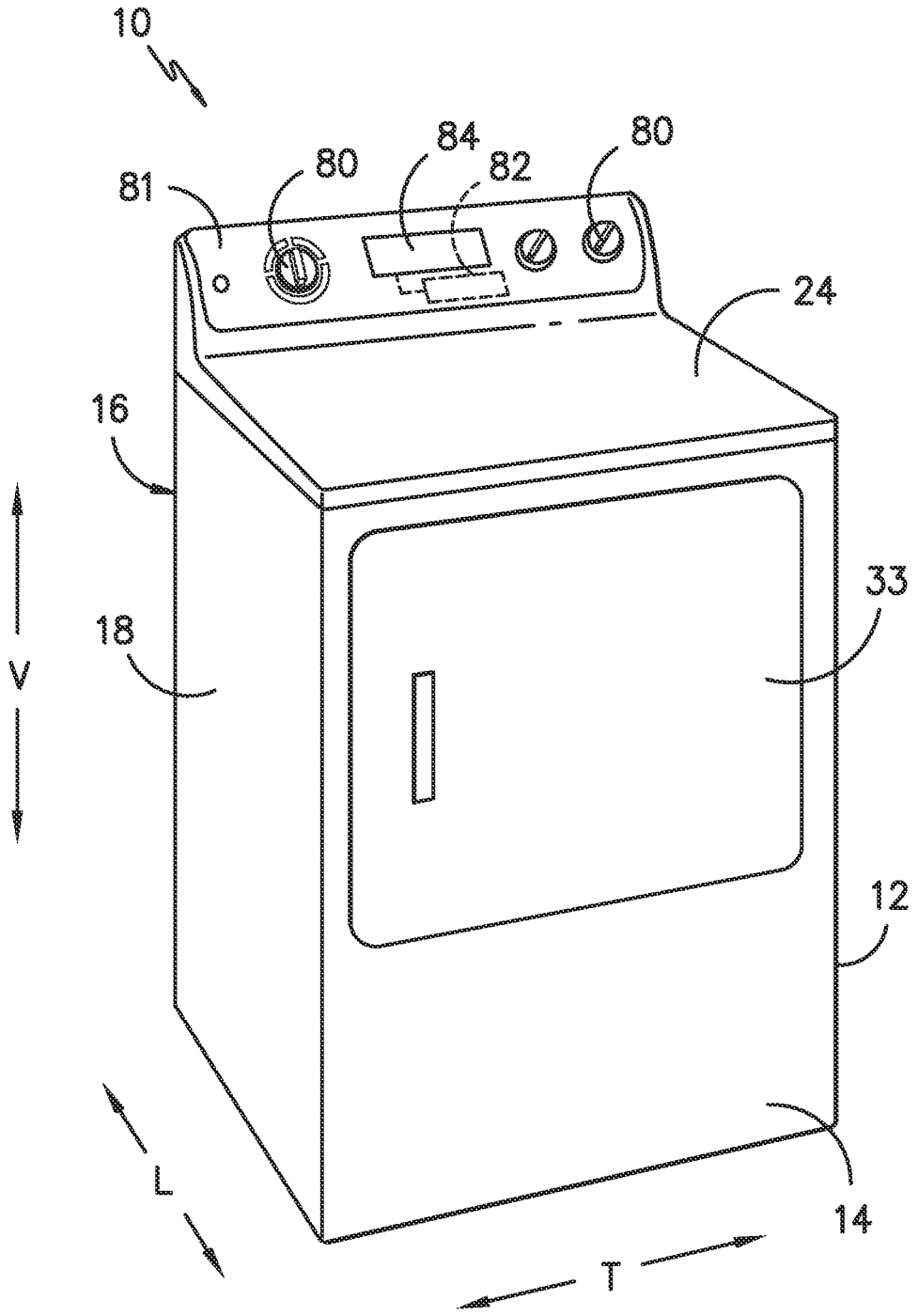
FIG. 1 provides a perspective view of a dryer appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
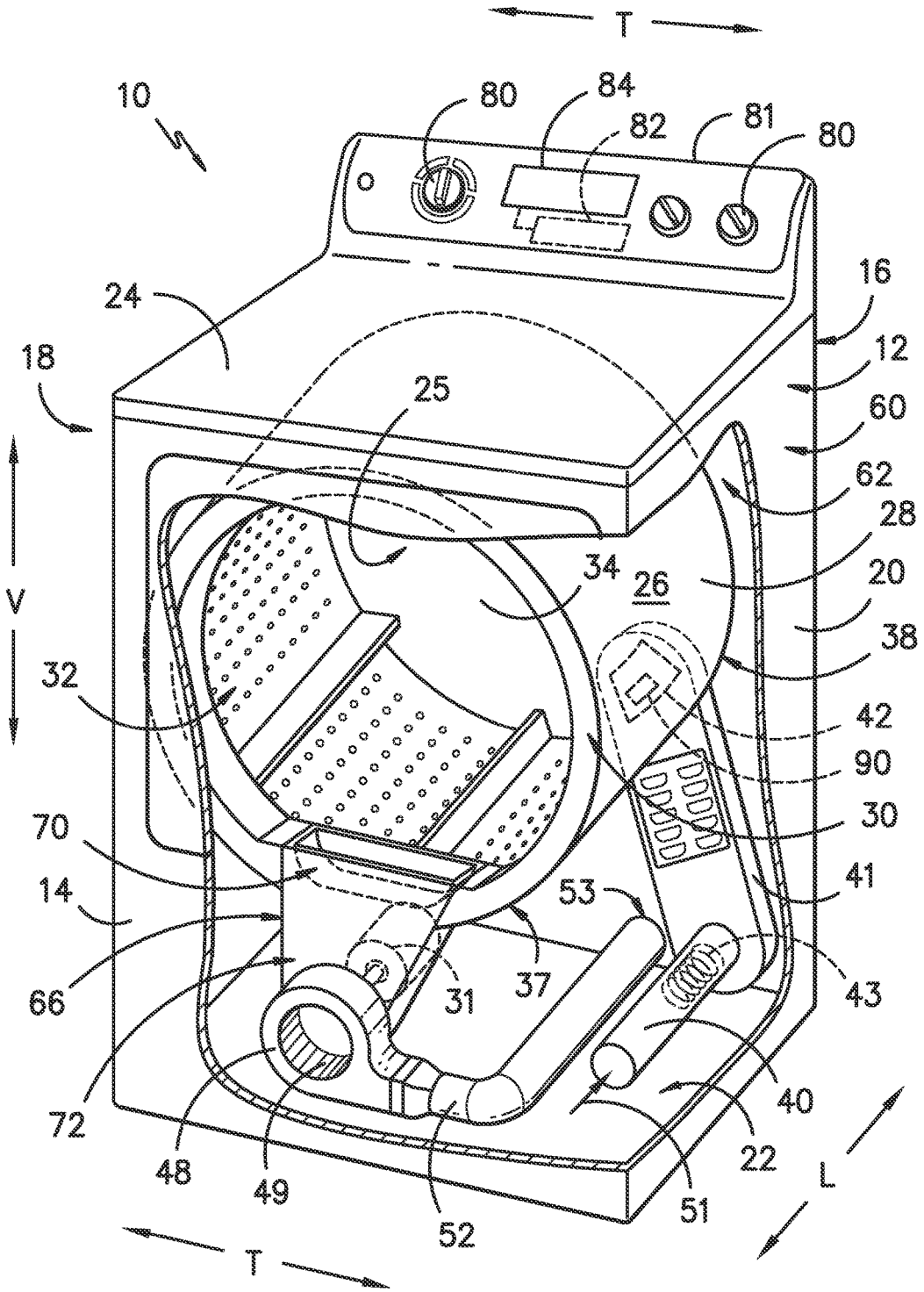
FIG. 2 provides a perspective view of the dryer appliance of FIG. 1 with portions of a cabinet of the dryer appliance removed to reveal certain components of the dryer appliance.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of the cabinet 12 and an interior 62 of the cabinet. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the lateral direction L. In exemplary embodiments the drum 26 is rotational. Alternatively, however, the drum 26 may be fixedly mounted within the interior 62.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. In alternative embodiments, entry 32 may be defined in top cover 24 and cylinder 28, and front wall 30 may be a generally solid wall.

A motor 31 may be in mechanical communication with a blower 48 such that motor 31 rotates a blower fan 49, e.g., of the blower 48. Blower 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of blower 48 independently of drum 26.

Drum 26 may be configured to receive heated air that has been heated by a heating assembly 40, e.g., in order to dry damp articles disposed within chamber 25 of drum 26. Heating assembly 40 includes a heater 43, such as a gas burner or an electrical resistance heating element, for heating air. As discussed above, during operation of dryer appliance 10, motor 31 rotates fan 49 of blower 48 such that blower 48 draws air through chamber 25 of drum 26. In particular, ambient air enters heating assembly 40 via an entrance 51 due to blower 48 urging such ambient air into entrance 51. Such ambient air is heated within heating assembly 40 and exits heating assembly 40 as heated air. Blower 48 draws such heated air through inlet duct 41 to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air in turn flows from the chamber 25 through an outlet assembly 64 positioned within the interior 62. The outlet assembly 64 includes a vent duct 66, the blower 48, and an exhaust conduit 52. The exhaust conduit 52 is in fluid communication with the vent duct 66 via the blower 48. During a dry cycle, internal air flows from the chamber 25 through the vent duct 66 to the blower 48 and through the blower 48 to the exhaust conduit 52, and is exhausted from the exhaust conduit 52 through outlet 53.

In exemplary embodiments, vent duct 66 can include a filter portion 70 and an exhaust portion 72. The exhaust portion 72 may be positioned downstream of the filter portion 70 (in the direction of flow of the internal air). A screen filter of filter portion 70 (which may be removable) traps lint and other particulates as the internal air flows therethrough. The internal air may then flow through the exhaust portion 72 and the blower 48 to the exhaust conduit 52.

After the clothing articles have been dried, they are removed from the drum 26 via entry 32. A door 33 provides for closing or accessing drum 26 through entry 32.

A cycle selector knob 80 is mounted on a cabinet backsplash 81 and is in communication with a processing device or controller 82. Signals generated in controller 82 operate motor 31 and heating assembly 40, including heater 43, in response to the position of selector knobs 80. Alternatively, a touch screen type interface may be provided. Additionally, a display 84, such as an indicator light or a screen, may be provided on cabinet backsplash 81. The display 84 may be in communication with the controller 82, and may display information in response to signals from the controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

In some embodiments, dryer appliance 10 may additionally include one or more sensors, such as a temperature sensor 90. The temperature sensor 90 may be operable to measure internal temperatures in the dryer appliance 10. In some embodiments, for example, the temperature sensor 90 may be disposed in the inlet duct 41, such as at outlet 42 of the inlet duct 41. In other embodiments, for example, the temperature sensor 90 may be disposed in the drum 26, such as in the chamber 25 thereof, or in any other suitable location within the dryer appliance 10. Temperature sensor 90 may be in communication with the controller 82, and may transmit temperature readings to the controller 82 as required or desired.

It should be understood that, while FIGS. 1 and 2 illustrate embodiments wherein dryer appliance 10 is a horizontal axis dryer appliance, in other embodiments dryer appliance 10 may be, for example, a vertical axis dryer appliance or another suitable dryer appliance. In a vertical axis dryer appliance 10, for example, cylinder 28 of drum 26 may extend along the vertical axis V between rear wall 34 and front wall 30. Accordingly, the present disclosure is not limited to horizontal axis dryer assemblies. Rather, any suitable dryer appliance is within the scope and spirit of the present disclosure.

Figure 3:
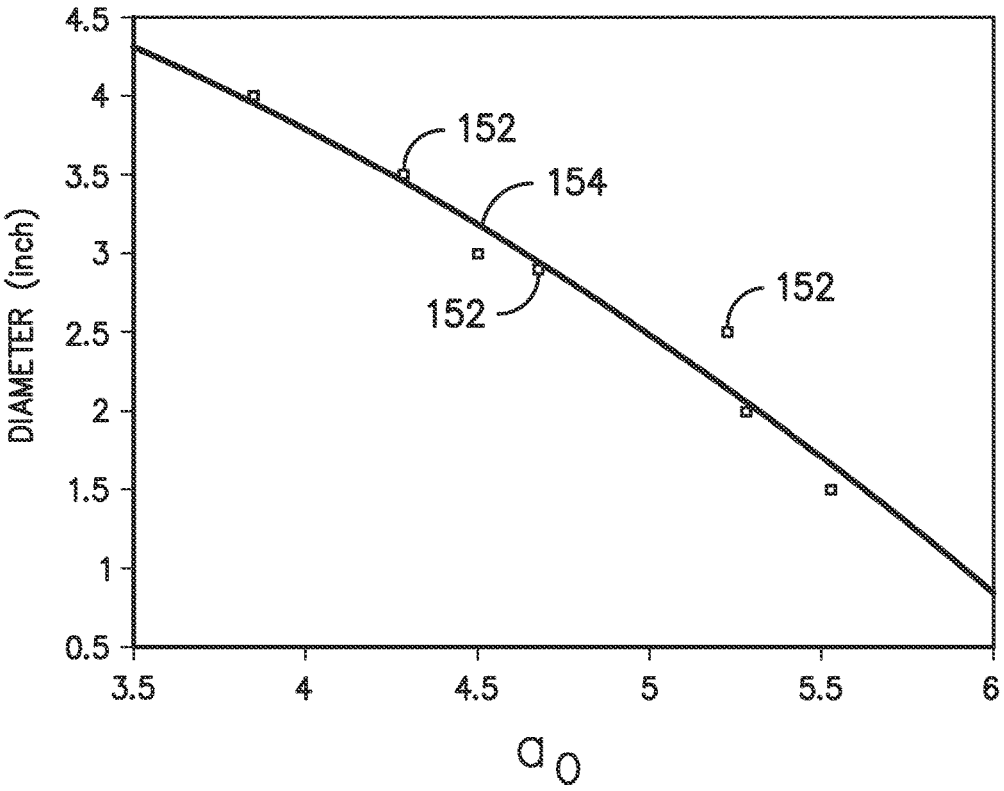
FIG. 3 provides a graph illustrating data correlating heater contribution rates with effective opening sizes for a dryer assembly in accordance with one embodiment of the present disclosure.
Figure 4:
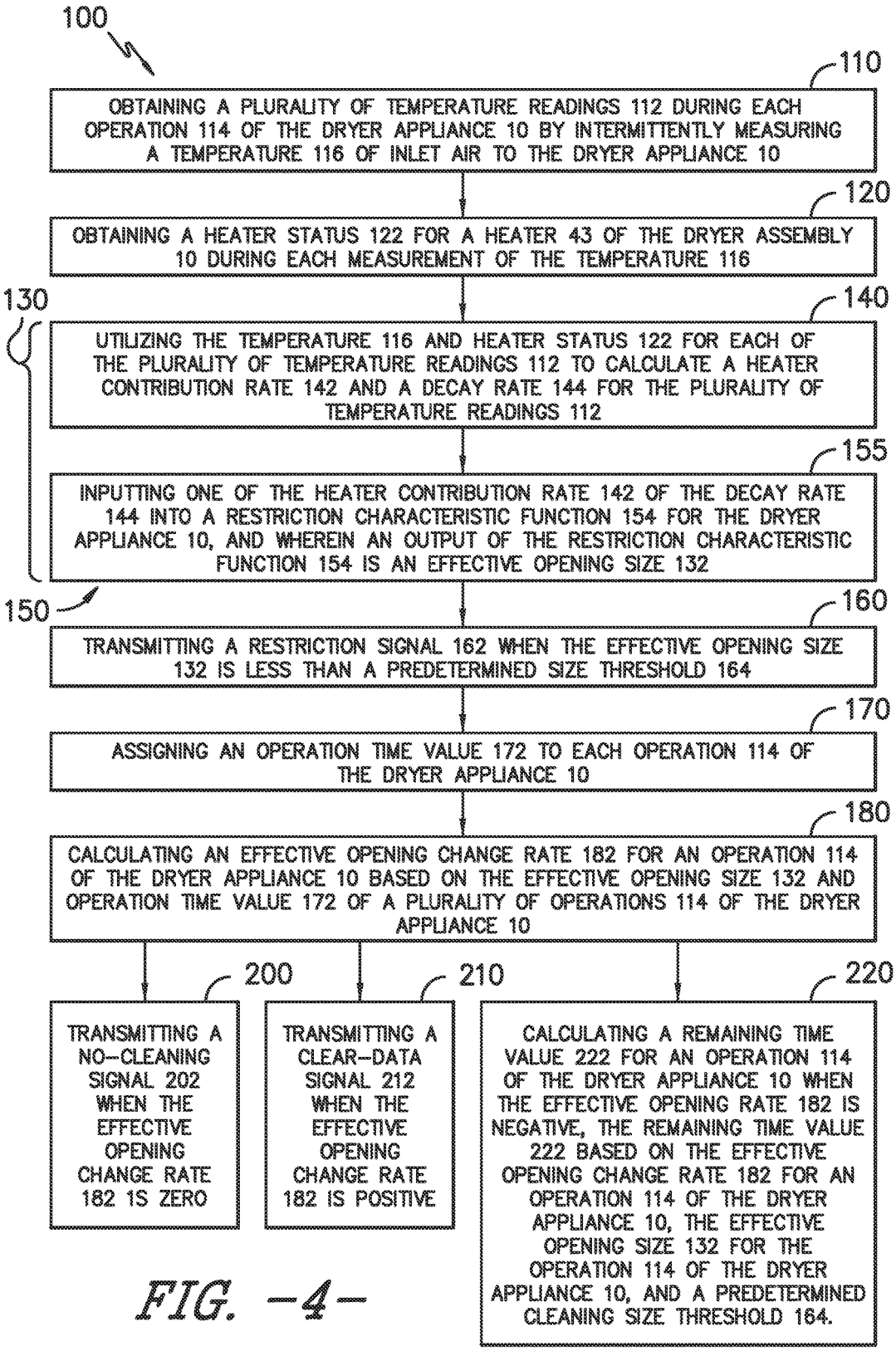
FIG. 4 is a flow chart illustrating method steps in accordance with one embodiment of the present disclosure.

Referring now to FIGS. 3 and 4, the present disclosure is further directed to methods for diagnosing restrictions in dryer appliances 10, as denoted generally by reference numeral 100. Such methods may generally measure temperatures within the dryer appliance 10, such as using temperature sensor 90, and may advantageously correlate these temperature readings to effective opening sizes, such as for the vent duct 66. Advantageously, such correlation in accordance with the present disclosure is accurate, and little or no additional hardware is required, thus reducing associated expenses. Further, methods in accordance with the present disclosure facilitate restriction trend tracking, such that time estimates may be provided before dryer appliance 10 cleaning, such as of the filter portion 70, the vent duct generally 66, or the exhaust conduit 52 or areas of the dryer appliance 10 susceptible to restrictions, is recommended or required.

Advantageously, in exemplary embodiments, the various method steps discussed herein may be performed by controller 82, which may for example be in communication with temperature sensor 90 as discussed.

Accordingly, as illustrated in FIG. 4, a method may include, for example, the step 110 of obtaining a plurality of temperature readings 112 during each operation 114 of the dryer appliance 10 by intermittently measuring a temperature 116 of inlet air to the dryer appliance 10. Temperature readings 112 may, for example, be taken by temperature sensor 90. In exemplary embodiments, for example, the intermittent measuring may occur at a predetermined time interval, such as a one minute interval, a two minute interval, etc., during an operation 114 of the dryer appliance 10. An operation 114 of the dryer appliance 10 is generally a use of the dryer appliance 10 to perform a dryer appliance 10 related function, such as a standard dry cycle, steaming, fluffing, etc.

Method 100 may further include the step 120 of obtaining a heater status 122 for a heater 43 of the dryer assembly 10 during each measurement of the temperature 116 as discussed above. For example, when the temperature sensor 90 takes a temperature reading 112, a heater status 122 may be obtained, such as from the heater 43 by the controller 82. Heater status may be selected from an "on" status, wherein the heater 43 is currently operating to produce heat when the temperature reading 112 is taken, and an "off" status, wherein the heater 43 is currently not operating to produce heat when the temperature reading 112 is taken. As discussed herein, for purposes of utilizing the heater status 122 in accordance with present methods and for example in a controller 82, an "on" status may be given a value of 1, and an "off" status may be given a value of 0.

Method 100 may further include the step 130 of estimating an effective opening size 132 in the dryer appliance 10 during each operation of the dryer appliance based on the temperature 116 and heater status 122 for each of the plurality of temperature readings 112. The effective opening size 132 may, for example, be a relative opening size that is estimated relative to an actual opening size in the dryer appliance 10, such as in the vent duct 66 or the exhaust conduit 52. An effective opening size 132 that is smaller than an actual opening size or that becomes smaller with various subsequent estimations, etc., may indicate the presence of a restriction.

Estimating step 130 may, for example, include the step 140 of utilizing the temperature 116 and heater status 122 for each of the plurality of temperature readings 112 to calculate a heater contribution rate 142 and a decay rate 144 for the plurality of temperature readings 112. For example, a suitable linear equation may be utilized to solve for heater contribution rate 142 and a decay rate 144. Simultaneous equations based on a suitable linear equation may be utilized, with temperature 116 and heater status 122 at multiple data points taken during an operation 114 of the dryer appliance 10 as inputs, to solve for heater contribution rate 142 and a decay rate 144. In one embodiment, the following equation may be utilized:

$$y[k]=a_0ER[k-1]+a_1y[k-1]$$

wherein y[k] is a temperature 116 at a certain data point taken intermittently during operation 114 of the dryer appliance 10; ER[k−1] is the heater status 122 during the previous data point relative to the data point y[k]; y[k−1] is the temperature 116 during the previous data point relative to the data point y[k]; $a_0$ is the heater contribution rate 142; and $a_1$ is the decay rate 144.

Estimating step 130 may further include, for example, the step 150 of utilizing one or both of the heater contribution rate 142 and the decay rate 144 to estimate the effective opening size 132. For example, the present inventors have discovered that one or both of heater contribution rate 142 and decay rate 144 may be correlated with effective opening size 132, such that an effective opening size 132 can be estimated based on the heater contribution rate 142 and/or the decay rate 144 after the heater contribution rate 142 and/or decay rate 144 have been determined. FIG. 3, for example, illustrates a graph correlating heater contribution rate 142 and effective opening size 132. Such correlation can be experimentally determined for a particular dryer appliance 10 by physically modifying an opening in the dryer appliance 10, such as of the vent duct 66 or the exhaust conduit 52, and determining heater contribution rate 142 and/or decay rate 144 as discussed above for that size actual opening. A plurality of data points 152 correlating heater contribution rate 142 with actual openings are illustrated. A restriction characteristic function 154 can then be calculated to generally fit the data points 152, as illustrated. The resulting empirically-determined characteristic function 154 can, for example, be programmed into the controller 82 for a dryer appliance 10, and can be utilized to output an effective opening size 132 for an input heater contribution rate 142 and/or decay rate 144. Accordingly, utilizing step 150 may include the step 155 of inputting the one of the heater contribution rate 142 or the decay rate 144 into a restriction characteristic function 154 for the dryer appliance 10, and wherein an output of the restriction characteristic function 154 is the effective opening size 132.

Accordingly, a method in accordance with the present disclosure may be utilized to determine an effective opening size 132. This effective opening size 132 may be utilized to determine if a restriction exists in the dryer appliance 10, and if the restriction requires immediate clearing or would require clearing in the future. For example, in some embodiments, method 100 may further include the step 160 of transmitting a restriction signal 162 when the effective opening size 132 is less than a predetermined minimum size threshold 164. Threshold 164 may, for example, be an absolute minimum acceptable opening size for generally optimal operation of the dryer appliance 10. The restriction signal 162 may, for example, be a "clear" signal indicating that clearing of a restriction is immediately required. In some cases, operation of the dryer appliance 10 may additionally be terminated when restriction signal 162 is transmitted, to facilitate such clearing. Restriction signal 162 may, for example, be transmitted to the display 84 by the controller 82 for display to a user of the dryer appliance 10.

A method 100 in accordance with the present disclosure may further advantageously be utilized to provide restriction trend tracking and time estimates before cleaning is required. For example, method 100 may further include the step 170 of assigning an operation time value 172 to each operation 114 of the dryer appliance 10. Such operation time value 172 may for example, be based on the start time for an operation 114 of the dryer appliance 10, and may catalogue and identify the time differences between subsequent operations 114 of the dryer appliance 10. Operation time values 172 may be based in seconds, minutes, hours, days, portions of days, or any other suitable time intervals. For example, an initial operation of the dryer appliance 10 on a particular day at a particular time may be assigned an operation time value 172 of 0. A subsequent operation the next day at the same time may be assigned an operation time value 172 of 24 (hours), 1 (day), or another suitable value in another suitable increment. Further subsequent operations may be similarly assigned operation time values 172 based off of the initial use.

Method 100 may further include, for example, the step 180 of calculating an effective opening change rate 182 for an operation 114 of the dryer appliance 10 based on the effective opening size 132 and operation time value 172 of a plurality of operations 114 of the dryer appliance 10. For example, a suitable linear equation may be utilized to solve for effective opening change rate 182. Simultaneous equations based on a suitable linear equation may be utilized, with effective opening size 132 and operation time value 172 at multiple data points taken for a plurality of operations 114 of the dryer appliance 10 as inputs, to solve for effective opening change rate 182 and a constant. In one embodiment, the following equation may be utilized:

$$D_t = b_0 + b_1 t$$

wherein $D_t$ is an effective opening size 132 at a particular operation time value 172, t is the particular operation time value 172, $b_0$ is a constant, and $b_1$ is the effective opening change rate 182.

The effective opening change rate 182 may be zero, negative, or positive. In embodiments wherein the effective opening change rate 182 is zero, this is an indication that no trend in restriction build-up is indicated. No cleaning of the dryer appliance 10 may thus be required. Accordingly, in some embodiments, method 100 may further include the step 200 of transmitting a no-cleaning signal 202 when the effective opening change rate 182 is zero. No-cleaning signal 202 may, for example, be transmitted to the display 84 by the controller 82 for display to a user of the dryer appliance 10.

In embodiments wherein the effective opening change rate 182 is positive, this is an indication that a restriction has been cleared. Resetting and clearing of data stored and utilized in accordance with the present method and/or in the controller 82 may thus be required. Accordingly, in some embodiments, method 100 may further include the step 210 of transmitting a clear-data signal 212 when the effective opening change rate 182 is positive. Clear-data signal 212 may, for example, be transmitted to the display 84 by the controller 82 for display to a user of the dryer appliance 10. In some embodiments, method 100 may further include the step of automatically clearing such data, such as from the controller 82. In other embodiments, a user may manually clear the data by, for example, selecting a user input based on the display 84 of the clear-data signal 212 that confirms an option to clear the data.

In embodiments wherein the effective opening change rate 182 is negative, this is an indication that a restriction is occurring or building up. Accordingly, in some embodiments, method 100 may further include the step 220 of calculating a remaining time value 222 for an operation 114 of the dryer appliance 10 when the effective opening change rate 182 is negative. The remaining time value 222 may be an estimated time remaining before clearing of a restriction is required. For example, in some embodiments, the remaining time value 222 may be an estimated time, based on the effective opening change rate 182, before the effective opening size 132 reaches a predetermined cleaning size threshold 224. The predetermined cleaning size threshold 224 may be an opening size that is equal to greater than that of the predetermined minimum size threshold 164. Remaining time value 222 may, for example, be based on the effective opening change rate 182 for an operation 114 of the dryer appliance 10, the effective opening size 132 for the operation 114 of the dryer appliance 10, and the predetermined cleaning size threshold 164. In one embodiment, the following equation may be utilized:

$$t^* = \frac{D_c - D_{tnow}}{b_1}$$

wherein $D_c$ is the predetermined cleaning size threshold 164, $D_{tnow}$ is the effective opening size 132, $b_1$ is the effective opening change rate 182, and t* is the remaining time value 222.

In some embodiments, method 100 may further include, for example, the step 230 of transmitting the remaining time value 222. Remaining time value 222 may, for example, be transmitted to the display 84 by the controller 82 for display to a user of the dryer appliance 10.

It should be noted that remaining time value 222 may be adjusted for each operation 114 of the dryer appliance 10, and in some embodiments may further be adjusted within an operation 114 of the dryer appliance 10 based on multiple uses of a method in accordance with the present disclosure. Further, when remaining time value 222 reaches zero, restriction signal 162 may be transmitted. Restriction signal 162 may, for example, be transmitted to the display 84 by the controller 82 for display to a user of the dryer appliance 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for diagnosing a restriction in a dryer appliance, the method comprising:

obtaining a plurality of temperature readings at a controller of the dryer appliance during each operation of the dryer appliance by intermittently measuring a temperature of inlet air to the dryer appliance from a temperature sensor mounted within a cabinet of the dryer appliance;

obtaining a heater status for a heater of the dryer appliance at the controller during each measurement of the temperature;

estimating an effective opening size equal to or smaller in relation to an actual opening size of an outlet assembly in the dryer appliance at the controller during each operation of the dryer appliance based on the temperature and heater status for each of the plurality of temperature readings, the estimating comprising calculating a heater contribution rate for temperature and a decay rate for temperature for the plurality of temperature readings at the controller utilizing the temperature and heater status for each of the plurality of temperature readings, and utilizing at least one of the heater contribution rate for temperature and the decay rate for temperature to estimate the effective opening size; and transmitting a restriction signal from the controller when the effective opening size is less than a predetermined minimum size threshold, wherein the effective opening size is correlated to the at least one of the heater contribution rate for temperature or the decay rate for temperature, wherein the heater contribution rate for temperature includes a rate of temperature increase at an active status of the heater, and wherein the decay rate for temperature includes a rate of temperature decrease at an inactive status of the heater.

2. The method of claim 1, wherein the intermittent measuring occurs at a predetermined time interval.

3. The method of claim 1, wherein the at least one of the heater contribution rate for temperature and the decay rate for temperature is the heater contribution rate for temperature.

4. The method of claim 1, wherein the utilizing step comprises inputting the at least one of the heater contribution rate for temperature and the decay rate for temperature into a restriction characteristic function for the dryer appliance, and wherein an output of the restriction characteristic function is the effective opening size.

5. The method of claim 1, further comprising assigning an operation time value to each operation of the dryer appliance.

6. The method of claim 5, further comprising calculating an effective opening change rate at the controller for an operation of the dryer appliance based on the effective opening size and operation time value of a plurality of operations of the dryer appliance.

7. The method of claim 6, further comprising calculating a remaining time value at the controller for an operation of the dryer appliance when the effective opening change rate is negative, the remaining time value based on the effective opening change rate for the operation of the dryer appliance, the effective opening size for the operation of the dryer appliance, and a predetermined cleaning size threshold, wherein the remaining time value for the operation of dryer appliance is an estimated time remaining before clearing of a restriction is required.

8. The method of claim 7, further comprising transmitting the remaining time value from the controller.

9. The method of claim 6, further comprising transmitting a no-cleaning signal from the controller when the effective opening change rate is zero.

10. The method of claim 6, further comprising transmitting a clear-data signal from the controller when the effective opening change rate is positive.

11. A dryer appliance, comprising:

a cabinet defining an interior;

a drum positioned within the interior, the drum defining a chamber for receipt of articles for drying;

a heating assembly;

an inlet duct providing fluid communication between the drum and the heating assembly;

an outlet assembly, the outlet assembly comprising a vent duct and an exhaust conduit;

a temperature sensor; and a controller, the controller in communication with the temperature sensor and the heating assembly and configured to initiate:

obtaining a plurality of temperature readings during each operation of the dryer appliance by intermittently measuring a temperature of inlet air to the dryer appliance;

obtaining a heater status for a heater of the heating assembly during each measurement of the temperature; and estimating an effective opening size equal to or smaller in relation to an actual opening size of the outlet assembly in the dryer appliance during each operation of the dryer appliance based on the temperature and heater status for each of the plurality of temperature readings, the estimating comprising calculating a heater contribution rate for temperature and a decay rate for temperature for the plurality of temperature readings utilizing the temperature and heater status for each of the plurality of temperature readings, and utilizing at least one of the heater contribution rate for temperature and the decay rate for temperature to estimate the effective opening size, wherein the effective opening size is correlated to the at least one of the heater contribution rate for temperature or the decay rate for temperature, wherein the heater contribution rate for temperature includes a rate of temperature increase at an active status of the heater, and wherein the decay rate for temperature includes a rate of temperature decrease at an inactive status of the heater.

12. The dryer appliance of claim 11, wherein the temperature sensor is disposed in one of the inlet duct or the drum.

13. The dryer appliance of claim 11, wherein the temperature readings are obtained from the temperature sensor.

14. The dryer appliance of claim 11, wherein the controller is further configured to initiate:

assigning an operation time value to each operation of the dryer appliance; and calculating an effective opening change rate for an operation of the dryer appliance based on the effective opening size and operation time value of a plurality of operations of the dryer appliance.

15. The dryer appliance of claim 14, wherein the controller is further configured to initiate calculating a remaining time value for an operation of the dryer appliance when the effective opening change rate is negative, the remaining time value based on the effective opening change rate for the operation of the dryer appliance, the effective opening size for the operation of the dryer appliance, and a predetermined cleaning size threshold, wherein the remaining time value for the operation of dryer appliance is an estimated time remaining before clearing of a restriction is required.

* * * * *